US006198899B1

(12) United States Patent
Takahashi et al.

(10) Patent No.: US 6,198,899 B1
(45) Date of Patent: Mar. 6, 2001

(54) IMAGE FORMING APPARATUS

(75) Inventors: Masashi Takahashi, Kanagawa-ken; Minoru Yoshida, Tokyo, both of (JP)

(73) Assignees: Toshiba Tec Kabushiki Kaisha, Tokyo; Kabushiki Kaisha Toshiba, Kawasaki, both of (JP)

( * ) Notice: Subject to any disclaimer, the term of this patent is extended or adjusted under 35 U.S.C. 154(b) by 0 days.

(21) Appl. No.: 09/456,557

(22) Filed: Dec. 8, 1999

(30) Foreign Application Priority Data

Dec. 15, 1998 (JP) ..... 10-355487

(51) Int. Cl.[7] ..... G03G 15/00; G03G 15/01
(52) U.S. Cl. ..... 399/303; 399/299; 399/306
(58) Field of Search ..... 399/303, 299, 399/306, 66; 347/115

(56) References Cited

U.S. PATENT DOCUMENTS

| | | | | |
|---|---|---|---|---|
| 5,469,248 | | 11/1995 | Fujiwara et al. | 355/326 |
| 5,602,633 | | 2/1997 | Yoshida et al. | 399/244 |
| 5,629,760 | * | 5/1997 | Hayashi et al. | 399/312 |
| 5,678,150 | * | 10/1997 | Takahashi et al. | 399/299 |
| 5,765,082 | * | 6/1998 | Numazu et al. | 399/299 |
| 5,893,017 | | 4/1999 | Yamamoto | 399/299 |
| 5,905,930 | * | 5/1999 | Toyama et al. | 399/299 |
| 5,907,758 | * | 5/1999 | Tanaka et al. | 399/303 |
| 5,960,241 | * | 9/1999 | Yoshida | 399/299 |
| 6,029,022 | * | 2/2000 | Takase | 399/66 |
| 6,029,023 | * | 2/2000 | Munemori et al. | 399/66 |
| 6,061,542 | * | 5/2000 | Minami et al. | 399/299 |

FOREIGN PATENT DOCUMENTS

| | | |
|---|---|---|
| 9-160328 | 6/1997 | (JP) . |
| 10-142932 | 5/1998 | (JP) . |
| 10-293437 | 11/1998 | (JP) . |
| 10-319664 | 12/1998 | (JP) . |

* cited by examiner

*Primary Examiner*—Richard Moses
(74) *Attorney, Agent, or Firm*—Foley & Lardner

(57) ABSTRACT

An image forming apparatus has first and second image carriers that are rotatably supported and includes image forming units to form an image on respective image carriers, a conveying belt that is kept in contact with the first and the second image carriers and conveys a sheet of paper to the contact between them, transfer units to transfer the image formed on the first and second image carriers onto a sheet of paper at the contact via the conveying belt, a charger to charge the conveying belt uniformly and a paper charging roller comprising a grounded conductive member that is kept in contact with the conveying belt.

12 Claims, 6 Drawing Sheets

IMAGE FORMING APPARATUS

BACKGROUND OF THE INVENTION

1. Field of the Invention

This present invention relates to a belt transferring type image forming apparatus that is used for electrophotographic copying machines, printers, etc., in particular, for quadruple drums tandem type color copying machines and color printers.

2. Description of the Related Art

Color copying machines, color printers, etc. for image forming using 4 color toners; yellow, magenta, cyan and black (hereinafter, abbreviated as Y, M, C and B, respectively) have been so far developed. As image forming systems using these four color toners, there are four systems as shown below:

1. A system to form an image by superposing 4 color toner images on one photosensitive drum and transfer this image collectively on a sheet of paper;

2. A transfer drum system to hold a sheet of paper on a transferring drum and form 4 color images on the sheet of paper by rotating the transferring drum 4 times;

3. An intermediate transferring body system to form images in four colors on an intermediate transfer body and transfer these images collectively on a paper; and 4. A quadruple drums tandem system with four photosensitive drums arranged in parallel and an image is formed on a sheet of paper during one pass.

Particularly, in case of a quadruple drums tandem type color image forming apparatus, an image is formed separately on each of four photosensitive drums that are arranged in parallel and a multi-transferred color image is formed by one pass of a sheet of paper through the drums and therefore, when compared with the above-mentioned systems 1–3, a time required in the image forming process can be shortened to ¼. So, this type of image forming apparatus is suited for achieving the high-speed image forming.

In this quadruple drums tandem system, one conveying belt is used and as disclosed in Japanese Published Unexamined Patent Application No. 110343/1994, etc., an apparatus to transfer an image formed on the photo-sensitive drums by a semi-conductive transferring belt and a transferring roller provided on the back of the conveying belt is devised.

However, even for an image forming apparatus using this quadruple drums tandem type image forming system, there are demands not only for outputting color images but also for the mono-color image formation. In the quadruple drums tandem system, the operations of four photosensitive drums and other devices are the same in the mono-color image formation and the full-color image formation. Therefore, even when it is desired to form an image in mono-color, other photosensitive drums not needed are also operated. So, there is such a defect that unnecessary image forming devices including other photosensitive drums, etc. are brought in contact with the conveying belt and consumed and the span of life is shortened. Therefore, the image forming apparatus is provided with a mono-color image forming mode so as to perform the mono-color image forming by bringing the conveying belt into contact with a mono-color photosensitive drum only, while other photosensitive drums are kept stopped to operate, thus ensuring a long life.

However, because one conveying belt is used for quadruple photosenstive drums at present, in order for bringing the conveying belt into contact with the mono-color B photosensitive drum and separating the Y, M and C photosensitive drums, a method to change the shape of the conveying belt is used. When this method is used, the belt tension cannot be precisely controlled and the belt weaves when it is rotated. When the conveying belt weaves, there is caused a problem that the image transferring position to a paper is shifted.

SUMMARY OF THE INVENTION

An object of the present invention is to provide an image forming apparatus in which a conveying belt to convey sheet of paper adsorbs a sheet of paper positively when forming an image in a single color.

According to the present invention, an image forming apparatus comprising image forming means, including first and second image carriers supported rotatably, for forming images on the first and second image carriers; conveying means for conveying an image receiving medium to the first and second image carriers; transfer means for transferring images formed on the first and second image carriers onto the image receiving medium conveyed by the conveying means; charging means for charging the conveying means uniformly; and ground means for grounding the conveying means by keeping a conductive member in contact with the conveying means, is provided.

DETAILED DESCRIPTION OF THE PREFERRED EMBODIMENTS

Figure 1:
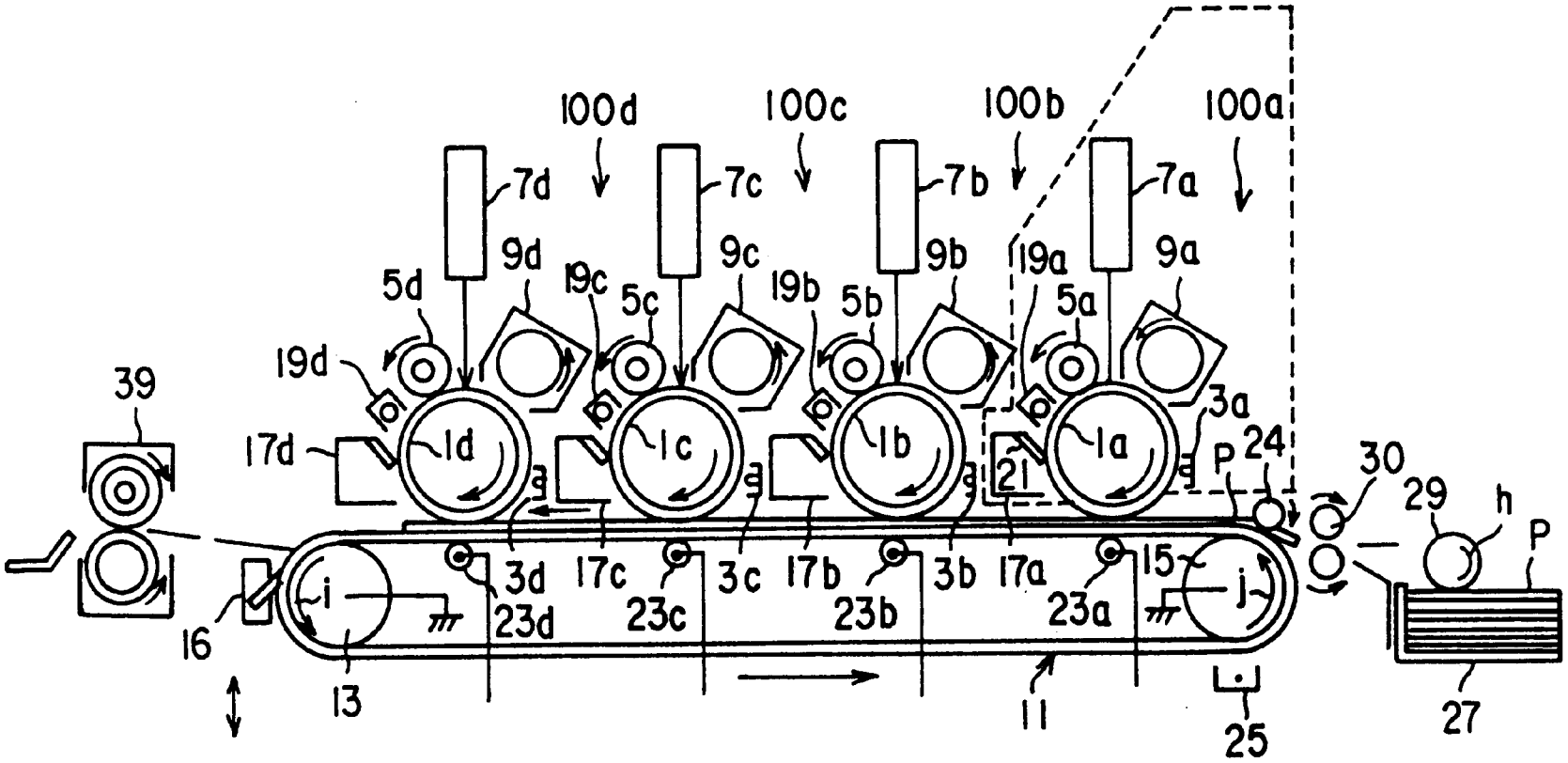
FIG. 1 is a schematic sectional view of an image forming apparatus of the present invention.

The preferred embodiments of an image forming apparatus having a plurality of photosensitive drums will be described below referring to the attached drawings. FIG. 1 is a sectional view showing an image forming apparatus in the preferred embodiment of the present invention. In FIG. 1, process units 100*a*, 100*b*, 100*c* and 100*d* are provided. Each of these process units forms a toner image independently. Each of these process units has a photosensitive drum 1*a*, 1*b*, 1*c* or 1*d*, respectively as an image carrier and form a toner image in different color on these photosensitive drums 1*a*, 1*b*, 1*c* and 1*d*.

Here, the process unit 100*a* will be first described. In FIG. 1, the photosensitive drum 1*a* is in a cylindrical shape 30 mm in diameter and provided rotatably in the direction as shown. Around the photosenstive drum 1*a*, a charging roller 5*a*, an exposing unit 7*a*, a developing unit 9*a*, a cleaner 17*a* and a charge elimination lamp 19*a* are arranged along the rotating direction. First, the charging roller 5*a* is provided in contact with the surface of the photosensitive drum 1*a* and uniformly minus (−) charges the photosensitive drum 1*a*. Then, the exposing unit 7*a* is provided to form an electrostatic latent image by exposing the uniformly charged photosensitive drum 1*a*. At the downstream of this rotating direction, the developing unit 9*a* is provided. This developing unit 9*a* contains Y (yellow) developer and inversely develops an electrostatic latent image formed by the exposing unit 7*a* with this yellow developer. Further, at the downstream side of the developing unit 9*a,* a conveying belt 11 is installed as a means to convey a sheet of paper P to the photosensitive drum 1*a* so as to bring a developer image formed on the photosensitive drum 1*a* in contact with the sheet of paper P.

At the downstream side from the contact position of the photosensitive drum 1*a* with a sheet of sheet of paper P, there are the cleaner 17*a* and the charge elimination lamp 19*a*. The cleaner 17*a* is provided with a blade 21 and removes a developer left on the photosensitive drum 1*a* after the transfer of an image. The charge elimination lamp 19*a* eliminates charge by uniformly irradiating the light to the surface charge of the photosensitive drum 1*a* after transferring an image. One cycle of the image formation is completed by the above operation and then, the next image forming process is carried out.

As described above, the process unit 100*a* is composed of the photosensitive drum 1*a,* charging roller 5*a,* exposing unit 7*a,* developing unit 9*a,* cleaner 17*a* and charge elimination lamp 19*a*.

The conveying belt 11 has a width that is nearly equal to the length of the photosensitive drum 1*a* in the direction (the depth direction in FIG. 1) of going straight to the conveying direction (the arrow direction e in FIG. 1) of a sheet of paper P. This conveying belt 11 is in a seamless belt shape and carried on a driving roller 13 that is rotated at a specified speed and a driven roller 15. A distance from the driving roller 13 to the driven roller 15 is about 30 mm. The driving roller 13 and the driven roller 15 are rotatably provided in the arrow directions i and j in FIG. 1, respectively. With the rotation of the driving roller 13, the conveying belt 11 is rotated and the driven roller 15 is driven accordingly. Further, the conveying belt 11 is applied with a sufficient tension so that it does not slip by the outward force of the driven roller 15.

The conveying belt 11 is formed with a 100 $\mu$m polyimide in which carbon is uniformly dispersed, has $10^{12}$ Ωcm electric resistance and shows semi-conductivity.

Any material having volume resistance showing semi-conductivity of $10^{9}$–$10^{13}$ Ωcm is usable as a material for the conveying belt. For instance, polyethylene terephthalate, polycarbonate, polytetrafluoro ethylene, polyvinilidene fluoride, etc. with conductive particles such as carbon, etc. dispersed are usable in addition to polyimide with carbon dispersed. Polymeric film that has electric resistance adjusted by the composition with ion conductive material mixed is also usable. Or rubber materials having that have relatively low electric resistance such as silicone rubber, urethane rubber, etc. are also usable.

On the conveying belt 11, the process units 100*a,* 100*b,* 100*c* and 100*d* are arranged between the driving roller 13 and the driven roller 15 along the conveying direction of a sheet of paper P.

The process units 100*b,* 100*c* and 100*d* are in the same structure as that of the process unit 100*a* as described above and what differs is only a developer housed in the developer. M (magenta), C (cyan) and B (block) developers are housed in the developers 19*b,* 19*c* and 10*d,* respectively.

Figure 7:
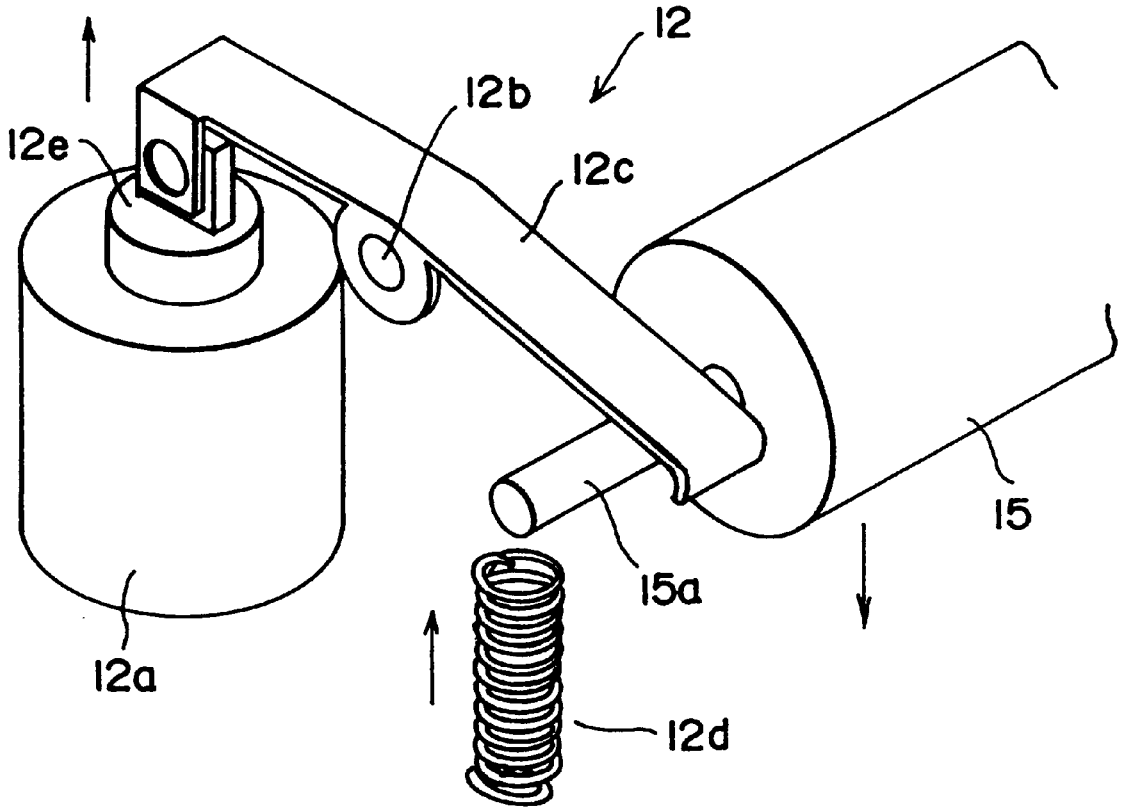
FIG. 7 is a perspective view showing a conveying belt contact/separation mechanism to bring the conveying belt shown in FIG. 6 in contact/separate with/from a photosensitive drum.

These process units 100*a*–100*d* are brought in contact with or separated from the conveying belt by the contact/separation mechanism shown in FIG. 7. Near the contacting positions of a sheet of paper P and respective photosensitive drums, transferring members 23*a,* 23*b,* 23*c* and 23*b* are provided as transferring means corresponding to the photosensitive drums 1*a,* 1*b,* 1*c* and 1*d*. That is, the transferring numbers 23*a,* 23*b,* 23*c* and 23*d* are provided below the corresponding photosensitive drums 1*a,* 1*b,* 1*c* and 1*d* with their backs kept in contact with the conveying belt 11, opposing the process units 100*a*–100*d* via the conveying belt 11. These transferring members 23*a,* 23*b,* 23*c* and 23*b* are connected to a positive DC power source that is not shown on the drawing.

On the other hand, at the front right side of the conveying belt 11, a paper supply cassette 27 is provided to house sheets of paper P. A pick-up roller 29 is provided rotatably in the direction h in FIG. 1 on the main body of the image forming apparatus to pick up a sheet of paper P at a time. Between the pick-up roller 29 and the conveying belt 11, an aligning roller pair 30 is rotatably provided and conveys a sheet of paper P on the conveying belt 11 at a specified timing.

a metal roller 24 is arranged on the conveying belt 11 for adsorbing a sheet of paper P electrostatically on the conveying belt 11. This metal roller 24 was grounded. Further, a corona charger 25 is installed below the driven roller 15 for charging the conveying belt 11. This electostatic adsorption will be described later in detail.

Figure 2:
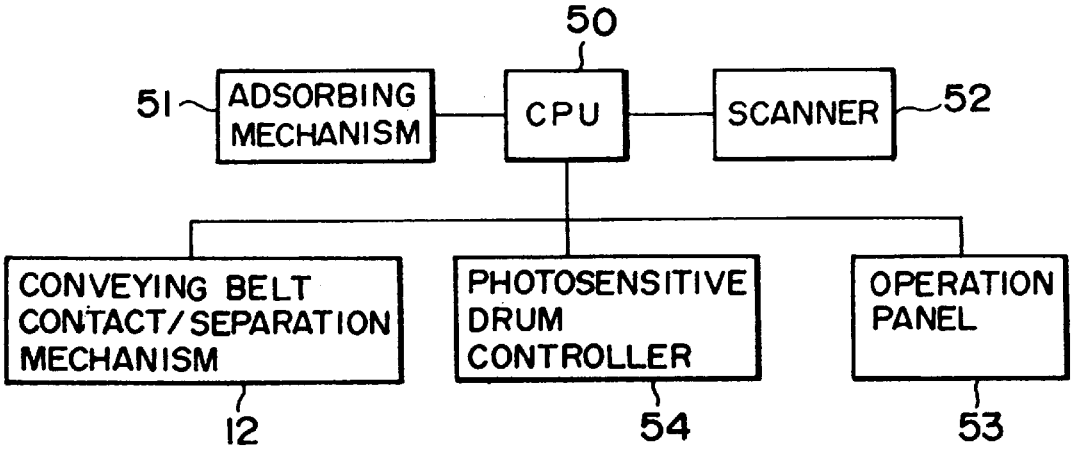
FIG. 2 is a control block diagram of an image forming apparatus of the present invention.

FIG. 2 shows a part of a block diagram for control of the image forming apparatus of the present invention. A CPU 50 that controls the entirety of this image forming apparatus is connected with a scanner 52, an adsorbing mechanism 51, an operation panel 53, a photosensitive drum control mechanism 54 and the conveying belt contact/separation mechanism 12 which will be described later, and controls these units. Each of the operations will be described later.

Figure 3:
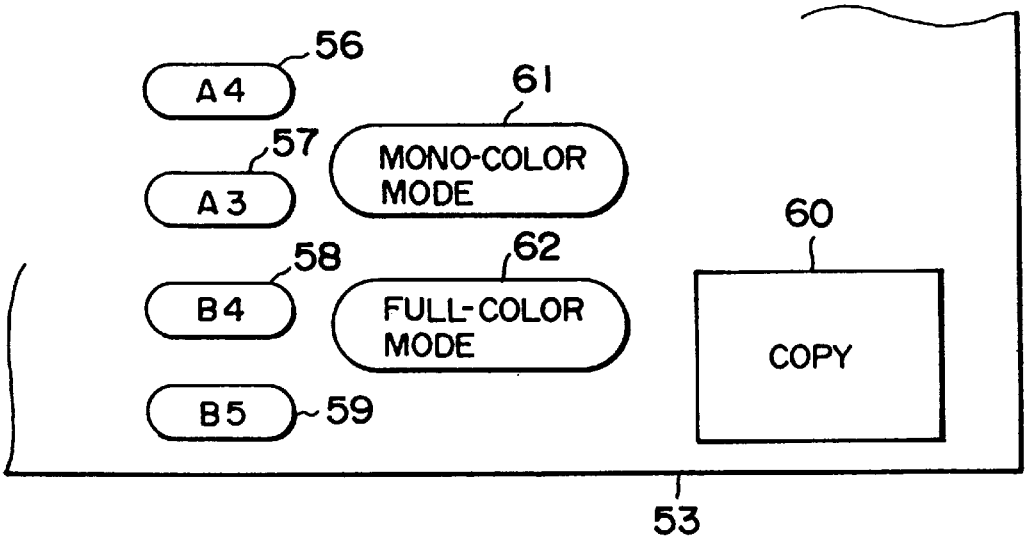
FIG. 3 is a plan view showing a part of a control panel.

FIG. 3 is a partial diagram of the operation panel. There are a copy start key 60 for directing the copy operation, a mono-color mode selecting key 61 for directing the monochrome color copying using the process unit 100*d* and a full-color mode selecting key 62 on this operation panel 53. Further, an A4 size key 56, and A3 size key 57, a B4 size key 58 and a B5 size key 59 are arranged on the operation panel 53 for selecting paper sizes. The using method of these keys will be described later.

The color image forming process of an image forming apparatus in the structure described above will be described. When the copy start key 60 on the operation panel 53 is depressed and the image forming start is directed, in the process unit 100*a,* the photosensitive drum 1*a* receives a driving force from a driving mechanism (not shown) and begins to rotate. The charging roller 5*a* charges the photosensitive drum 1*a* uniformly to about −600V. At the stage where it becomes possible to form an image, a transferring unit comprising the conveying belt 11, driving roller 13, driven roller 16, transferring member 23 and metal roller 24 is brought in contact with the photosensitive drum 1*a* by the driving mechanism (not shown). The exposing unit 7*a* irradiates rays of light corresponding to an image to be recorded to the photosensitive drum 1*a* that is uniformly charged by the charging roller 5*a* and forms an electrostatic latent image. In the same steps as above, an image is formed on the photosensitive drums 1*b,* 1*c* and 1*d,* respectively.

On the other hand, the pick-up roller 29 picks up a sheet of paper P from the paper supply cassette and the aligning roller pair 30 conveys this sheet of paper P on the conveying belt 11 at a specified timing. The sheet of paper P is conveyed successively to the photosensitive drums 1*a*–1*d*.

When a paper P reaches a transferring area formed by the photosensitive drum 1*a*, conveying belt 11 and transferring member 23*a*, bias voltage of about +1,000V is applied to the transferring member 23*a* and a transferring electric field is formed between the photosensitive drum 1*a* and the transferring member 23*a*. Out of developer images formed on the photosensitive drum 1*a*, a toner image developed in Y developer is first transferred on a sheet of paper P.

In succession, on the sheet of paper P arrives at the process unit 100*b*, a toner image developed in M developer in the same process as described above is transferred by applying about 1,200V bias voltage from the transferring member 23*b*. Thereafter, in the similar manner, a C toner image is transferred on the sheet of paper P by applying about 1,400V bias voltage in the process unit 100*c* and a B toner image is transferred on the sheet of paper P by applying about 1,600V bias voltage in the process unit 100*d*, and the multi-transferring is completed. The multi-transferred toner images in respective colors are fixed on the sheet of paper P and a full-color image is formed.

Figure 4:
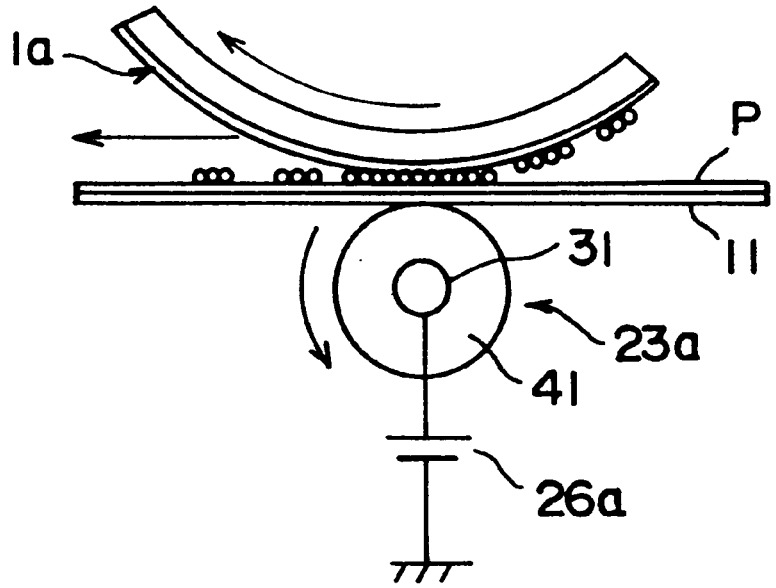
FIG. 4 is a schematic diagram showing the transferring mechanism of image to sheet.

Next, the transferring units described above will be explained more in detail using FIG. 4 and FIG. 5. The transferring member 23*a* is a carbon dispersed conductive foamed urethane roller. A roller 41 in the outer diameter ø16 mm is formed over a ø6 mm core metal 31. Electric resistance between the core metal 31 and the roller surface is about $10^6$ Ω. A constant voltage DC power source 26*a* is connected to he core metal. However, the transferring member 23*a* described above can be an ion conductive type roller. Further, it is not restricted to a roller but can be a conductive brush, conductive rubber blade, conductive sheet, etc. A conductive sheet is a carbon dispersed rubber material or a resin film and can be such rubber materials as silicone rubber, urethane rubber, EPDM, etc. or polycarbonate. Further, materials having volume resistance $10^5$–$10^7$ Ωcm are desirable.

Figure 5:
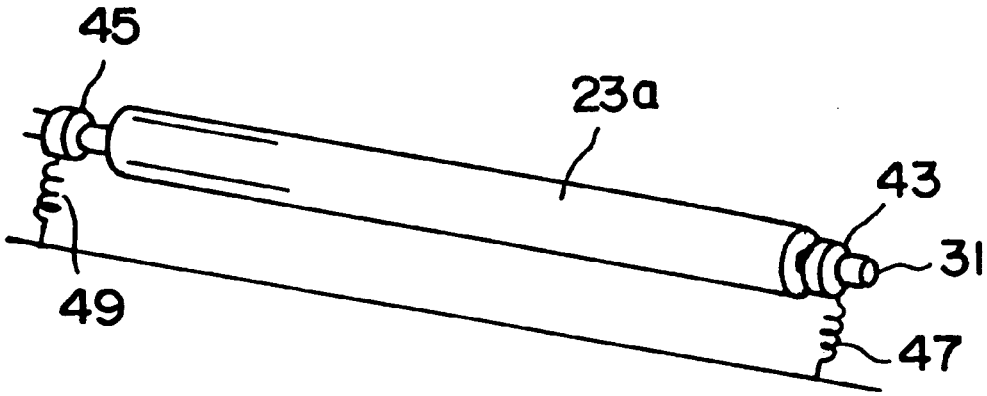
FIG. 5 is a perspective view showing the structure of a transferring member.

As shown in FIG. 5, the transferring member 23*a* is installed so that its center comes to right blow from the vertical direction of the rotary center of the photosensitive drum 1*a*. At both ends of the core metal 31, springs 47 and 49 are provided as a pressing means. The transferring member 23*a* is pressed in the vertical direction so that is elastically brought in contact with the conveying belt 11. Size of pressing force of the springs 47 and 49 provided for the transferring members 23*a*–23*d* is made 1000 gft. The pressing force referred to here denotes a total pressing force of 500 gft by the spring 47 and 500 gft by the spring 49.

Next, the mono-color mode image forming process will be described. When the user selects the mono-color mode key 61 on the operation panel of the image forming apparatus or when a document in mono-color only is detected by analyzing image data by the pre-scanning with a scanner (not shown), etc. or when a mono-color print is designated for image data sent to the CPU 50, the operation shown below is carried out in order to perform the mono-color image formation.

Figure 6:
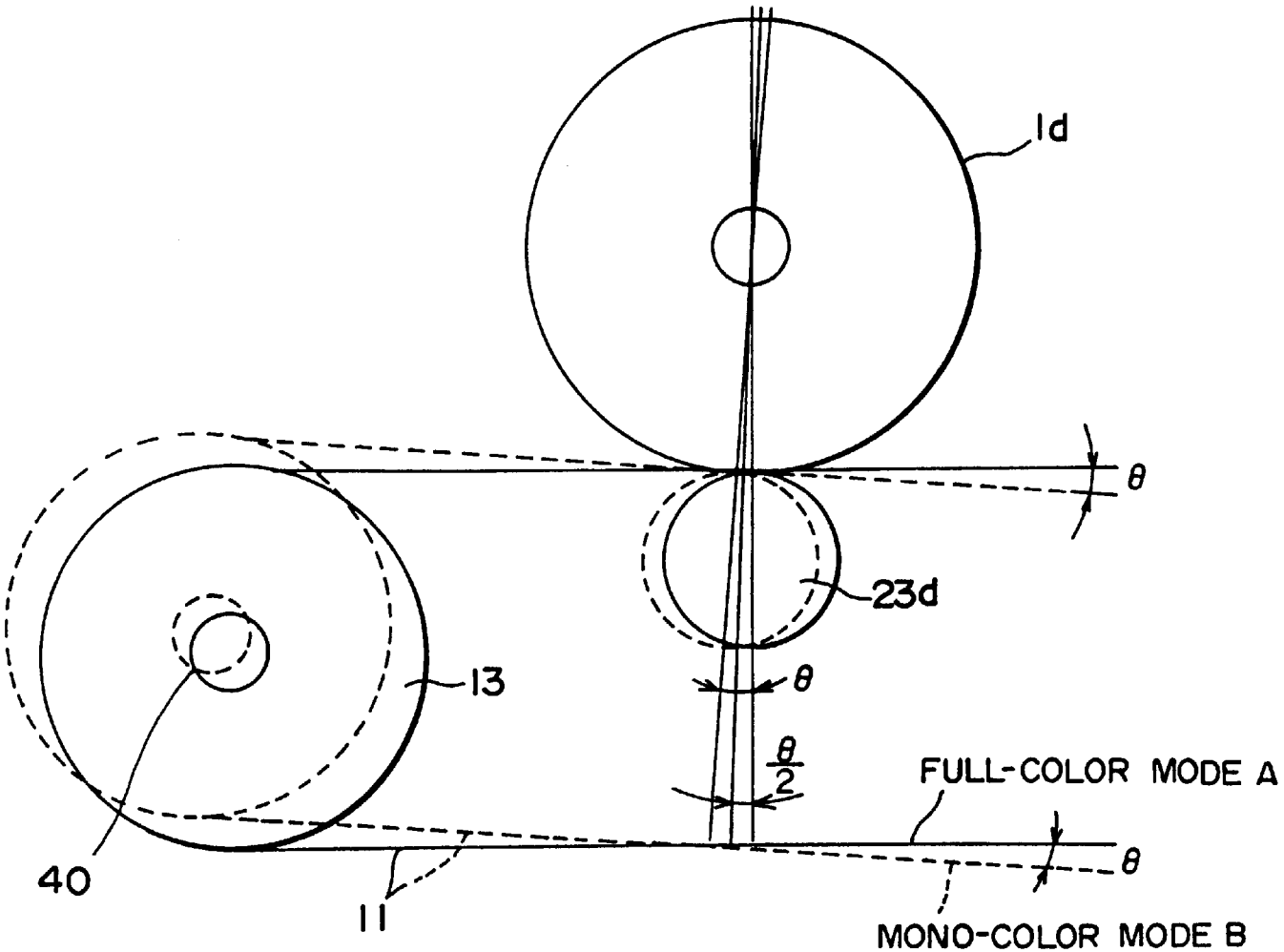
FIG. 6 is a schematic diagram showing a conveying belt separation method.

First, the structure will be described. The transferring unit in the structure as described above is constructed by the conveying belt contact/separation mechanism 12 shown in FIG. 7 so as to perform the separation operation without changing the stretched state of the conveying belt 11. That is, the shaft of the driven roller 15 is pushed down by a mechanism (not shown) from the ordinary state (in the full-color mode A shown by the solid line in FIG. 6) and the shaft of the driving roller 13 moves in the arrow direction in FIG. 6 according to this movement along a frame having a slit 40 at an equal distance from the rotating center of the photosensitive drum 1*d* (the mono-color mode B shown by the dotted line in the figure). Because the shaft of this driving roller 13 moves while constantly maintaining a certain distance from the photosensitive drum 1*d*, the conveying belt 11 moves so as to change the nip area (the contact between the photosensitive drum and the conveying belt) while being kept in contact with the outer surface of the photosensitive drum 100*d*. The transferring member 23*d* also moves corresponding to the change in this nip area and is continuously kept at the position where it is able to make the transfer. As a result of the construction described above, the photosensitive drums 1*a*–1*d* are separated from the conveying belt 11. Further, in the case of the above construction, the nip area slightly shift to the downstream in the rotating direction of the photosensitive drum from the ordinary color image forming position and therefore, the image forming timing of the process unit 100*d* is corrected by the CPU 50 so that the image forming is carried out later than the ordinary timing.

As shown in FIG. 7, the conveying belt contact/separation mechanism 12 is composed of a solenoid 12*a* fixed to the frame of the main body (not shown), a crank 12*c* of which middle point is rotatably supported on the frame of the main body by a shaft 12*b*, and a compression spring 12*d* provided between the driven roller 15 and the frame of the main body to press the driven roller 15 upward. One end of these crank 12*c* is connected to the plunger 12*e* of the solenoid 12*a* and the other end is engaged with the shaft 15*a* of the driven roller 15. A conveying belt contact/separation mechanism in the same structure is also provided at the other end of the driven roller 15.

Next, a sheet of paper adsorbing mechanism will be explained. In the mono-color mode B, the adsorption of paper to the conveying belt becomes necessary. The reason is that when the conveying belt 11 is a separated from the photosensitive drums 1*a*–1*d*, there will be generated a problem that a sheet of paper P is not stably conveyed. That is, in case of the full-color image formation, a distance from the aligning roller pair 30 to the nip area, that is a contact between the photosensitive drum 1*a* and the conveying belt 11 is short as shown in FIG. 1 and paper P is not distorted when conveyed. However, in the mono-color mode A, as the photosensitive drums 1*a*–1*d* are separated from the conveying belt 11, a sheet of paper P shifts when conveyed by the conveying belt 11 and the image formation is not properly carried out and therefore, an adsorbing mechanism becomes necessary.

Figure 8:
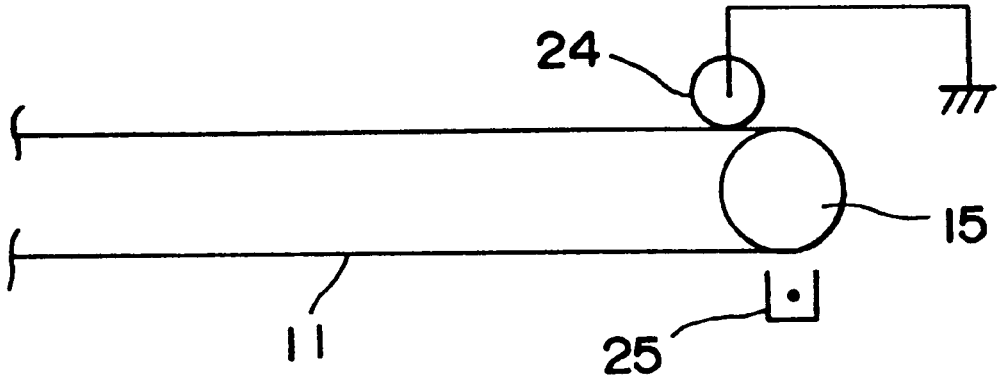
FIG. 8 is a schematic diagram showing a sectional view of a adsorbing mechanism of the present invention.

This adsorbing mechanism is in the structure as shown in FIG. 8. Below the driven roller 15, there is provided a corona charger 25. Further, a metal roller 24 is arranged while kept in contact with the conveying belt 11. When the image forming operation is carried out in this structure, the corona charger 25 charges the conveying belt 11 uniformly by applying +5 kV voltage. That is, in the state carrying no a sheet of paper P on the conveying belt 11. The conveying belt 11 may be charged, for instance, by the contact charge using a conductive brush. At this state, paper P is conveyed onto the conveying belt 11 by the aligning roller pair 30. The conveyed paper P passes between the metal roller 24 and the conveying belt 11. At this time, by a potential difference between the potential on the surface of the conveying belt 11 which is pre-charged with (+) charge and the potential of the material roller 24, an electric field is formed between tem and the dielectric polarization is taken place inside a paper P. At this state on the surface of a paper P at the grounded roller 24 side, (−) charge of reverse polarity to (+) charge of the conveying belt 11 is caused. As a result, the conveying belt 11 adsorbs a paper P. Further, when this adsorbing mechanism is used, bias of the may possibly prevent disorder of the image formation. That is, when a conventional adsorbing mechanism is used, (−) bias is applied to a paper P. In a humid environment, a resistance value drops when a sheet of paper adsorbs moisture, and current is applied and adsorbing bias interferes with transferring bias with when the leading edge of a paper reached the nip area of the photosensitive drum at the stage wherein bias is still being applied, and the image formation is disordered. However, as adsorbing bias is not applied in this invention, there is no interference to the transferring members and no defective transfer is generated. Further, the more the distance between the corona charger 25 and the metal roller 24 is short, the more the adsorbing force increases. This is because the conveying belt 11 has the semi-conductivity, the conveying belt 11 is not kept charged so long.

Further, it is possible to last the adsorbing force of a paper P to the conveying belt 11 by maintaining the conveying belt 11 kept charged by applying bias to the transferring members 23*a*–23*c* in the image forming. Under the humid environment, a paper P becomes conductive when adsorbs moisture and therefore, when the transferring members 23*a*–23*c* are operated when a paper P passes, current flows through a paper P by a difference in bias voltages applied between the transferring members 23*a*–23*c* and this and the relation with the charge of the conveying belt 11, the conveying belt 11 and a paper P are adsorbed each other. Thus, sufficient adsorbing performance is obtained even under the humid environment of the conveying belt 11.

The operation of the mono-color mode B in the above structure will be explained. When the CPU 50 recognizes the mono-color mode B according to the method described above and the mono-color mode B is started, the driven roller 15 is pressed down by the conveying belt contact/separation mechanism 12 and the operating mode is shifted from the state of the full-color mode A shown by the solid line in FIG. 6 to the state of the mono-color mode B shown by the dotted line in FIG. 6. Under this state, the conveying belt 11 and the photosensitive drum 1*d* begin to rotate and the charge 25 applies (+) bias voltage to the conveying belt 11. That is, in the state carrying no a sheet of paper P on the conveying belt 11. Under this state, the image formation becomes possible, a paper P is conveyed and the image formation is carried out.

Further, except when forming an image, the conveying belt and the photosensitive drum are in the separated state as before, and using this structure, it is possible to prevent wear of the photosensitive drum and the conveying belt in this invention. When using this method, it is only required to bring the conveying belt 11 into contact with the photosensitive drum 1*d* after shifting the conveying belt to the mono-color mode B from the full-color mode A.

As explained in the above, according to the embodiment of the present invention, a transferring device that is capable of preventing the meandering of the conveying belt by bringing it into contact with one of four photosensitive drums without changing its tensile force and shape. Further, it is possible to assure the adsorption of paper to the conveying belt, which becomes a problem when bringing the conveying belt to the photosensitive drum, without affecting an image, and prevent the shifting of a paper from the required position. Thus, when the full-color image formation is not required, consumption, wear, etc. of unnecessary members and devices can be prevented and a long life of the entire apparatus can be achieved.

As described above, according to this invention, it becomes possible to prevent the meandering of the conveying belt and shifting of paper that are generated when the conveying belt is separated from the photosensitive drum during the image formation in the mono-color mode. It is possible to provide an image forming apparatus that is capable of extending the life of the entire apparatus because members that were so far consumed can be kept in the unused state.

What is claimed is:

1. An image forming apparatus comprising:

image forming means, including first and second image carriers supported rotatably, for forming images on the first and second image carriers;

conveying means for conveying an image receiving a medium to the first and second image carriers;

transfer means for transferring images formed on the first and second image carriers onto the image receiving medium conveyed by the conveying means;

charging means for charging the conveying means uniformly;

ground means for grounding the conveying means by keeping a conductive member in contact with the conveying means; and a contact/separation mechanism for bringing at least the second image carrier in contact with or separate it from the conveying belt by shifting the contact of the conveying means with the first image carrier by rotating and moving the conveying means and the transfer means with the rotary shaft of the first image carrier as a supporting point.

2. An image forming apparatus according to claim 1, wherein the transfer means is in operation as long as the second image carrier and the conveying means are separated by the contact/separation mechanism.

3. An image forming apparatus according to claim 1, wherein the conveying means is composed of semi-conductive resin in which carbon is dispersed.

4. An image forming apparatus according to claim 3, wherein the conveying means is made of a seamless belt.

5. An image forming apparatus according to claim 3, wherein the conveying means is formed with a 100 $\mu$m thick polyimide in which carbon is uniformly dispersed, having electric resistance $10^{12}$ Ωcm.

6. An image forming apparatus comprising:

image forming means, including first and second image carriers supported rotatably, for forming images on the first and second image carriers;

conveying means for conveying an image receiving medium to the first and second image carriers;

transfer means for transferring images formed on the first and second image carriers onto the image receiving medium conveyed by the conveying means;

charging means for charging the conveying means that is in the state carrying no image receiving medium on the conveying means after transferring the images formed on the first and second image carriers onto the image receiving medium by the transfer means;

a conductive member that is charged by the charging means, kept in contact with the conveying means conveying the image receiving medium and the conductive member being grounded; and a contact/separation mechanism for bringing at least the second image carrier in contact with or separate it from the conveying belt for shifting the contact of the conveying means with the first image carrier by rotating and moving the conveying means and the transfer means with the rotary shaft of the first image carrier as a supporting point.

7. An image forming apparatus according to claim 6, wherein the transfer means is in operation as long as the second image carrier and the conveying means are separated by the contact/separation mechanism.

8. An image forming apparatus according to claim 6, wherein the conveying means is composed of semiconductive resin in which carbon is dispersed.

9. An image forming apparatus according to claim 8, wherein the conveying means is made of a seamless belt.

10. An image forming apparatus according to claim 8, wherein the conveying means is formed with a 100 $\mu$m thick polyimide in which carbon is uniformly dispersed, having electric resistance $10^{12}$ Ωcm.

11. An image forming method comprising the steps of:

forming images on first and second image carriers;

conveying an image receiving medium to the first and second image carriers by a conveying means which is made of a seamless belt;

transferring the image formed on the first and second image carriers onto the conveyed image receiving medium;

wherein the conveying steps including:

charging the conveying means after transferring the image onto the image receiving medium;

feeding an image receiving medium to the charged conveying means; and bringing the conveying means carrying the image receiving medium in contact with a grounded conductive member.

12. An image forming method according to claim 11, wherein the seamless belt is formed by a 100 $\mu$m thick polyimide in which carbon is uniformly dispersed, having electric resistance $10^{12}$ Ωcm.

* * * * *